US006394367B2

(12) United States Patent
Munezane et al.

(10) Patent No.: US 6,394,367 B2
(45) Date of Patent: May 28, 2002

(54) FUEL INJECTION VALVE

(75) Inventors: Tsuyoshi Munezane, Hyogo; Mamoru Sumida, Tokyo, both of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/888,647

(22) Filed: Jun. 26, 2001

(30) Foreign Application Priority Data

Jul. 24, 2000 (JP) ..... 2000-221643

(51) Int. Cl.[7] ..... B05B 1/30

(52) U.S. Cl. ..... 239/533.12; 239/552; 239/533.14; 239/585.1; 239/900; 239/596

(58) Field of Search ..... 239/533.12, 533.14, 239/585.1, 585.2, 585.3, 585.4, 585.5, 900, 596, 552

(56) References Cited

U.S. PATENT DOCUMENTS

| | | | | |
|---|---|---|---|---|
| 4,101,074 A | | 7/1978 | Kiwior | 239/585 |
| 5,762,272 A | * | 6/1998 | Tani et al. | 239/585.4 |
| 5,862,991 A | * | 1/1999 | Willke et al. | 239/585.4 |
| 5,931,391 A | * | 8/1999 | Tani et al. | 239/585.4 |
| 6,070,812 A | * | 6/2000 | Tani et al. | 239/533.12 |
| 6,161,780 A | * | 12/2000 | Sugimoto et al. | 239/533.12 |
| 6,170,763 B1 | * | 1/2001 | Fuchs et al. | 239/533.12 |

FOREIGN PATENT DOCUMENTS

| | | | |
|---|---|---|---|
| DE | 38 08 396 A1 | 9/1989 | F02M/61/18 |
| DE | 197 24 075 A 1 | 12/1998 | B21D/53/84 |
| DE | 197 26 991 A 1 | 1/1999 | F16K/25/00 |
| EP | 0 740 071 A2 | 10/1996 | F02M/51/06 |
| JP | 9-14090 | 1/1997 | |
| JP | 10-122096 | 5/1998 | |
| JP | 11-200998 | 7/1999 | |
| JP | 11-264365 | 9/1999 | |

* cited by examiner

*Primary Examiner*—Robin O. Evans
(74) *Attorney, Agent, or Firm*—Sughrue Mion, PLLC

(57) ABSTRACT

A fuel injection valve includes an orifice plate having a plurality of discharge orifices formed therein. A valve seat is disposed upstream of the discharge orifices and has a cylindrical fuel passage formed therein. A fuel cavity is formed between the cylindrical fuel passage and the orifice plate directly above the discharge orifices. A valve member is supported for reciprocating movement into and out of contact with the valve seat. The fuel injection valve satisfies the inequalities $$\phi D1+\phi d<\phi P \text{ and } t<\phi d$$

wherein $\phi$D1 is the diameter of the cylindrical fuel passage, $\phi$d is the diameter of each discharge orifice, $\phi$P is the diameter of an imaginary circle passing through the center of each discharge orifice, and t is the depth in the axial direction of the fuel cavity.

3 Claims, 4 Drawing Sheets

FUEL INJECTION VALVE

REFERENCE TO RELATED APPLICATIONS

This application is based on Japanese Patent Application No. 2000-221643, filed in Japan on Jul. 24, 2000, the contents of which are hereby incorporated by reference.

BACKGROUND OF THE INVENTION

1. Field of the Invention

This invention relates to a fuel injection valve for an internal combustion engine.

2. Description of the Related Art

Fuel injection valves are widely used to supply fuel to internal combustion engines. One example of a known fuel injection valve for use with an internal combustion engine is disclosed in Japanese Published Unexamined Patent Application Hei 9-14090. FIG. 6 is a cross-sectional elevation of a fuel injection valve disclosed in that publication, and FIG. 7 is an enlarged view of the lower end of the fuel injection valve of FIG. 6.

The illustrated fuel injection valve 1 includes an electromagnetic coil 3, a stationary ferromagnetic core 4, and metal plates 5 defining a magnetic path, all disposed in a resin housing 2. The electromagnetic coil assembly 3 includes a resin bobbin 3*a*, a coil 3*b* which is wound around the outer periphery of the bobbin 3*a*, and a terminal 6 which is electrically connected to the coil 3*b* and which enables the coil 3*b* to be electrically connected to an external source of electric power. The resin housing 2 is molded around the electromagnetic coil assembly 3.

An adjuster 8 for adjusting the load of a compression spring 7 is secured inside the stationary core 4. Two metal plates 5 (only one of which is visible) which form a magnetic path each have one welded to the stationary core 4 and another end welded to a magnetic pipe 9 which forms a magnetic path. A non-magnetic pipe 11 is disposed between and secured to the fixed core 4 and the magnetic pipe 9 such that a movable ferromagnetic core 10 disposed inside the magnetic pipe 9 can move up and down.

One end of the movable core 10 is welded to a needle 101, and the other end of the movable core 10 abuts against the compression spring 7. A valve head 101*a* is formed on the other end of the needle 101 and is guided with respect to a valve seat 102 by a guide portion 101*b*.

The valve head 101*a* is moved between an open and a closed position by an electromagnetic drive mechanism disposed at the upper portion. The valve head 101*a* opens and closes the valve by moving out of or into contact with the top surface of the valve seat 102. When the valve head 101*a* is in an open position, fuel flows past the valve head 101*a* to an orifice plate having discharge orifices 103 formed therein and is sprayed from the discharge orifices 103 to the exterior of the fuel injection valve into an internal combustion engine.

In the conventional fuel injection valve shown in FIGS. 6 and 7, the direction of fuel injection is determined by the angle of inclination of the discharge orifices 103 in the orifice plate with respect to the longitudinal axis of the fuel injection valve 1. Upstream of the orifice plate, fuel flows from the outer peripheral portion to the inner peripheral portion, so it is difficult to obtain a large spray angle for the fuel. Furthermore, when manufacturing a one-spray type having a large spray angle (such as approximately 15 degrees or greater) or a two-spray type having a large spray angle (such as approximately 15 degrees or greater), it is necessary to make the angle of inclination of the discharge orifices 103 large, so it is difficult to form the discharge orifices so as to have a small diameter, and it is difficult and to make the diameter of the discharge orifices 103 small to obtain atomization of the fuel. Even if discharge orifices 103 with a large angle of inclination and a small diameter can be formed, the manufacturing costs for forming such discharge orifices are significant. This is especially the case with respect to an orifice plate having at least six discharge orifices 103 to promote atomization, since with such an orifice plate the diameter of the discharge orifices 103 becomes particularly small, so processing of the orifice plate becomes very difficult.

By increasing the ratio L/ϕd of the length L of the discharge orifices 103 to their diameter ϕd, the spray direction can be regulated and the spray angle can be increased, but in this case, the atomization of the fuel is worsened. Furthermore, when L/ϕd is made large, it becomes difficult to form the discharge orifices 103 in the orifice plate, and increasing the angle of inclination of the discharge orifices 103 increases the difficulty of forming the discharge orifices in the orifice plate, resulting in extreme increases in manufacturing costs.

Japanese Published Unexamined Patent Application Hei 10-122096 discloses a fuel injection valve having a dish-shaped orifice plate in which a fuel cavity is formed. Such an orifice plate is extremely expensive to manufacture.

SUMMARY OF THE INVENTION

The present invention provides a fuel injection valve which can have discharge orifices with a small diameter to promote atomization of fuel without an orifice plate containing the discharge orifices being expensive to manufacture.

According to one form of the present invention, a fuel injection valve includes an orifice plate having a plurality of discharge orifices formed therein. A valve seat is disposed upstream of the discharge orifices and has a cylindrical fuel passage formed therein. A fuel cavity is formed between the cylindrical fuel passage and the orifice plate directly above the discharge orifices. A valve member is supported for reciprocating movement into and out of contact with the valve seat. The fuel injection valve satisfies the inequalities $$\phi D1+\phi d<\phi P \text{ and } t<\phi d$$

wherein ϕD1 is the diameter of the cylindrical fuel passage, ϕd is the diameter of each discharge orifice, ϕP is the diameter of an imaginary circle passing through the center of each discharge orifice, and t is the depth in the axial direction of the fuel cavity.

In a preferred embodiment, the fuel injection valve satisfies the inequality $$1<S2/S1<3$$

wherein S1 is the total cross-sectional area of the discharge orifices, and S2 is the surface area of a cylindrical surface having a diameter equal to the diameter ϕD1 of the cylindrical fuel passage and a height equal to the axial depth t of the fuel cavity.

In a preferred embodiment, the fuel cavity is formed in the valve seat, and the orifice plate is a flat member.

DESCRIPTION OF PREFERRED EMBODIMENTS

Figure 1:
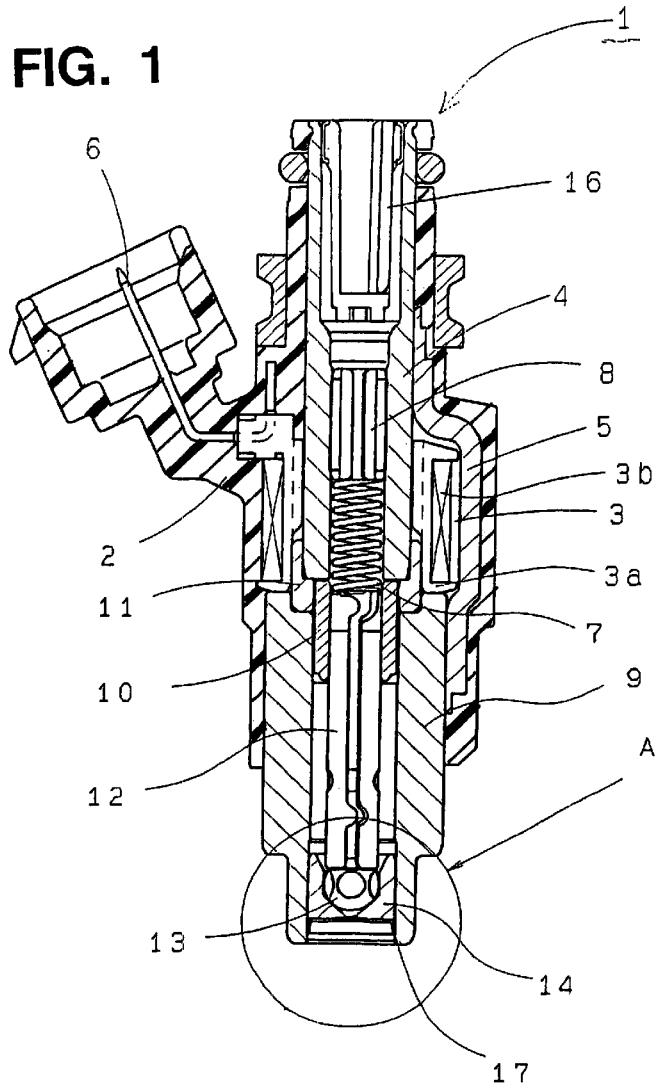
FIG. 1 is a cross-sectional elevation of a first embodiment of a fuel injection valve according to the present invention.

A number of preferred embodiments of a fuel injection valve according to the present invention will be described while referring to the accompanying drawings. FIG. 1 is a cross-sectional elevation of a first embodiment of a fuel injection valve 1 according to the present invention. The fuel injection valve 1 includes an electromagnetic coil 3, a stationary ferromagnetic core 4, and metal plates 5 defining a magnetic path, all disposed in a resin housing 2. The electromagnetic coil assembly 3 includes a resin bobbin 3*a*, a coil 3*b* which is wound around the outer periphery of the bobbin 3*a*, and a terminal 6 which is electrically connected to the coil 3*b* and which enables the coil 3*b* to be electrically connected to an external source of electric power. The resin housing 2 is molded around the electromagnetic coil assembly 3.

An adjuster 8 which adjusts the load of a compression spring 7 is secured inside the fixed core 4. Two metal plates 5 (only on of which is shown) which form a magnetic path each have one end secured by welding to the fixed core 4 and another end welded to a magnetic pipe 9 which forms a magnetic path. A non-magnetic pipe 11 is secured to the fixed core 4 and the magnetic pipe 9 between the fixed core 4 and the magnetic pipe 9 so that a movable ferromagnetic core 10 which is disposed inside the magnetic pipe 9 can move up and down.

A needle pipe 12 is secured by welding to one end of the movable core 10. The upper end of the needle pipe 12 abuts against the compression spring 7, and a valve member in the form of a ball 13 is secured by welding to the other end. The ball 13 is guided by a valve seat 14 which is disposed within the magnetic pipe 9 and can move into and out of contact with the upper surface 14*a* of the valve seat 14. The outer periphery of the ball 13 has a pentagonal shape, and it forms a fuel passage together with a guide portion 14*b* of the valve seat 14. A cylindrical fuel passage 14*c* and a fuel cavity 14*d* which communicates with the fuel passage 14*c* are formed in the valve seat 14. An orifice plate 17 in which a plurality of discharge orifices 18 are formed is disposed on the lower side of the valve seat 14 so as to cover the fuel cavity 14*d*.

The illustrated fuel injection valve operates in the following manner. When current is supplied to the coil assembly 3 from the exterior of the fuel injection valve through the terminal 6, a magnetic flux is generated in the magnetic path formed by the fixed core 4, the metal plates 5, the magnetic pipe 9, and the movable core 10, and the movable core 10 is pulled upwards towards the fixed core 4 by the electromagnetic attractive force. The needle pipe 12 which is joined to and integral with the movable core 10 and the ball 13 which is secured by welding to the needle pipe 12 move upwards with the movable core 10, the fuel passage formed between the upper surface 14*a* of the valve seat 14 and the ball 13 is opened by the upwards movement of the ball 13, and fuel is injected from the discharge orifices 18 provided in the orifice plate 17.

Fuel is supplied to the fuel injection valve 1 through a delivery pipe (not shown) and flows into the upper end of the fuel injector valve 1 and passes through a filter 16, the interior of the adjuster 8 and the compression spring 7, the movable core 10, and the needle pipe 12. The fuel further passes through the fuel passage formed between the valve seat guide portion 14*b* and the outer periphery of the ball 13, it passes along the upper surface 14*a* of the valve seat 14 into the cylindrical fuel passage 14*c* and the fuel cavity 14*d*, and it is sprayed to the exterior of the fuel injection valve through the discharge orifices 18 formed in the orifice plate 17.

Figure 2:
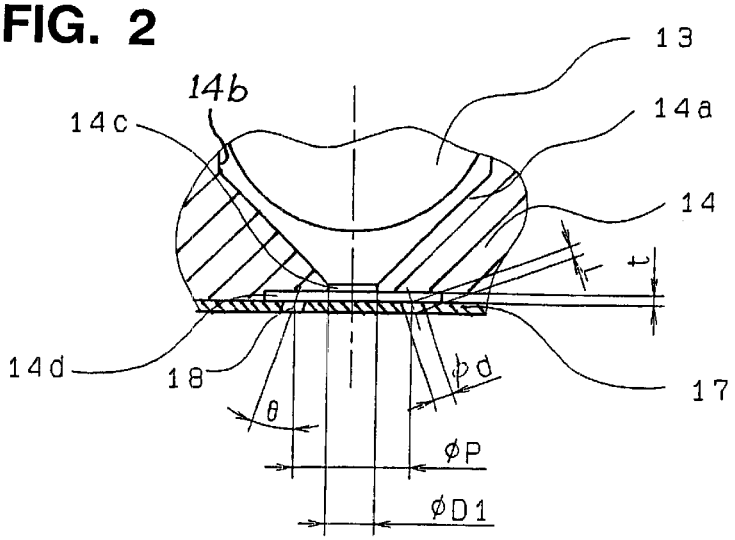
FIG. 2 is an enlarged cross-sectional elevation showing the region containing the discharge orifices at the lower end of the fuel injection valve of FIG. 1.

FIG. 2 illustrates the dimensions of various portions of the fuel injection valve 1. $\phi d$ is the diameter of each discharge orifice 18 formed in the orifice plate 17. L is the axial length of each discharge orifice 18. $\phi P$ is the diameter of an imaginary circle passing through the center of each of the discharge orifices 18. $\theta$ is the angle of inclination of each discharge orifice 18, i.e., the angle of the axis of the orifice 18 with respect to the longitudinal axis of the fuel injection valve 1. $\phi D1$ is the diameter of the cylindrical fuel passage 14*c*. t is the depth in the axial direction of the fuel cavity 14*d*. By satisfying the inequalities $\phi D1+\phi d<\phi P$ and $t<\phi d$, turbulence is produced in the flow of fuel, and the fuel which is discharged from the discharge orifices 18 is sufficiently atomized. Furthermore, the flow of fuel is directed from the center of the fuel cavity 14*d* outwards, so for a given spray angle, the angle of inclination $\theta$ of the discharge orifices 18 in the orifice plate 17 can be reduced, and the orifice plate 17 can be inexpensively manufactured.

Figure 3:
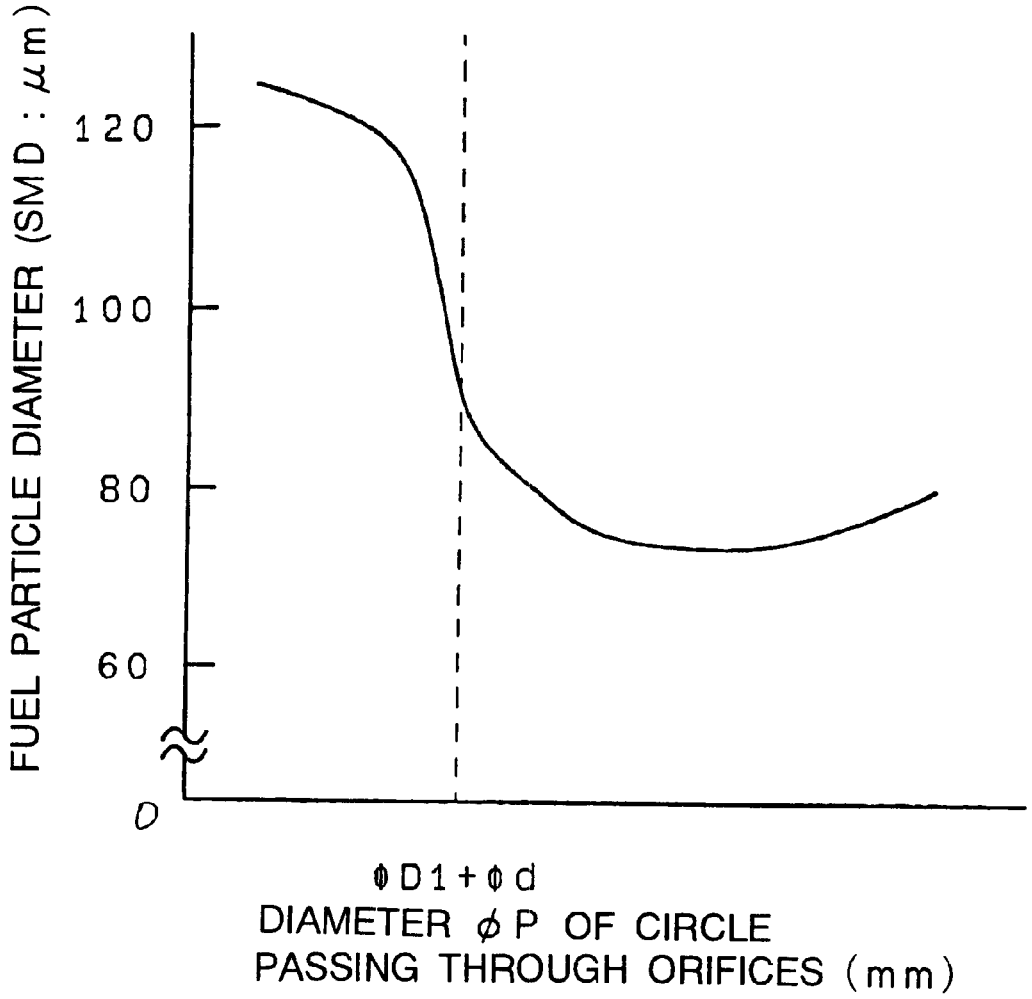
FIG. 3 is a graph showing the relationship between the diameter P of an imaginary circle passing through the discharge orifices in a fuel injection valve according to the present invention and the particle diameter (SMD) of fuel sprayed from the fuel injection valve.

FIG. 3 is a graph showing an example of the relationship between $\phi P$ (in millimeters) and the SMD (Sauter Mean Diameter in micrometers) of fuel particles measured for a fuel injection valve in which $t<\phi d$. As is clear from this graph, as a general tendency, as $\phi P$ increases, the SMD of the fuel particles decreases. As the value of $\phi P$ approaches $\phi D1+\phi d$, SMD starts to abruptly decrease from approximately 120 micrometers, and when $\phi P=\phi D1+\phi d$, SMD becomes approximately 90 micrometers. When $\phi P$ becomes larger than $\phi D1+\phi d$, the value of SMD becomes still smaller and decreases to approximately 70 micrometers, and the desirable effect is obtained that the fuel particle diameter decreases by approximately 50%.

Figure 4:
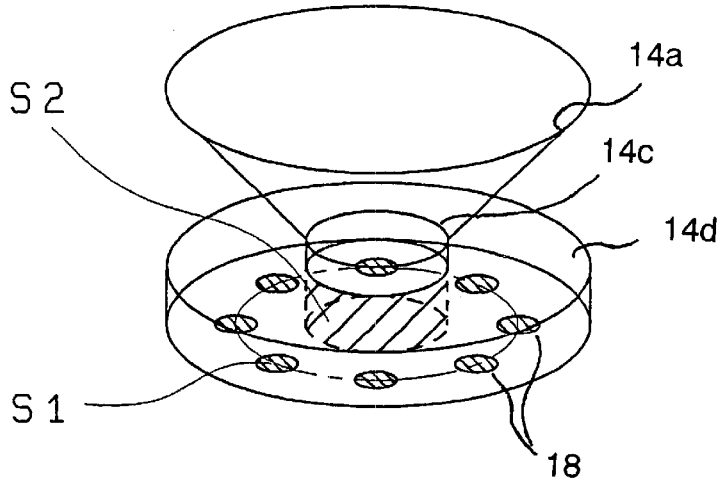
FIG. 4 is a schematic perspective view showing the region containing the discharge orifices of a second embodiment of a fuel injection valve according to the present invention.

FIG. 4 is a schematic perspective view of the lower end of a second embodiment of a fuel injection valve according to the present invention. In this embodiment, the atomization of fuel in the fuel injection valve is further promoted by not only satisfying the above-described inequalities $\phi D1+\phi d<\phi P$ and $t<\phi d$ but by also selecting the overall cross-sectional area S1 of the discharge orifices 18 so as to satisfy a prescribed relationship. In this embodiment, the ratio S2/S1 of the surface area S2 of an imaginary cylindrical surface extending from the cylindrical fuel passage 14*c* as shown in FIG. 4 and the total cross-sectional area S1 of the discharge orifices 18 (which is the sum of the cross-sectional areas of the individual discharge orifices 18 provided in the orifice plate 17) is made to satisfy the inequality $1<S2/S1<3$. The cylindrical surface having the surface area S2 has a diameter equal to the diameter ØD1 of the cylindrical fuel passage 14*c*, and it has a height equal to the axial depth t of the fuel cavity 14*d*.

Figure 5:
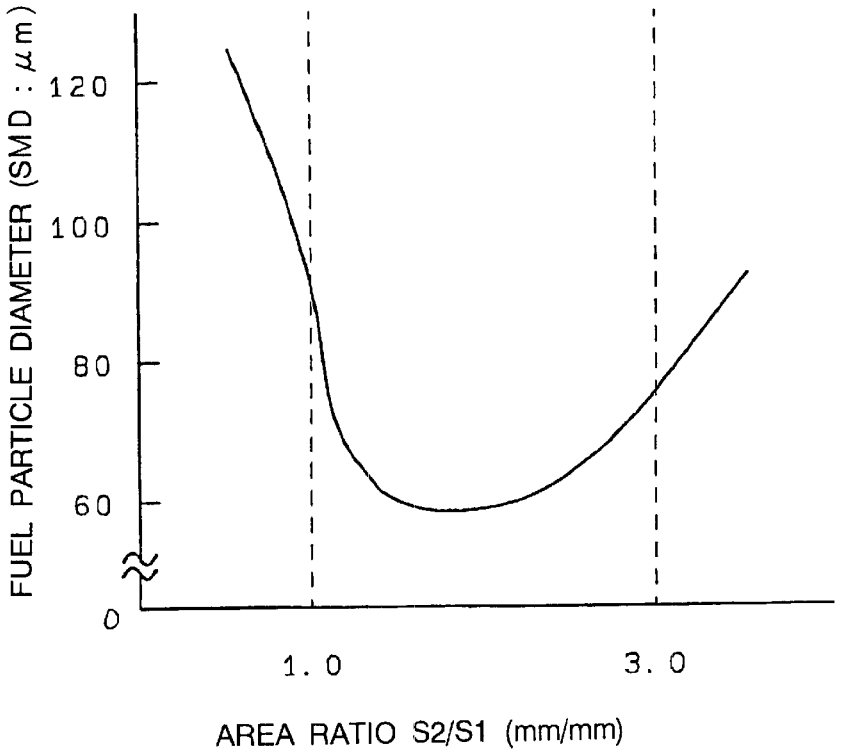
FIG. 5 is a graph showing the relationship between the area ratio S2/S1 and the fuel particle diameter (SMD) for the embodiment of FIG. 4.
Figure 6:
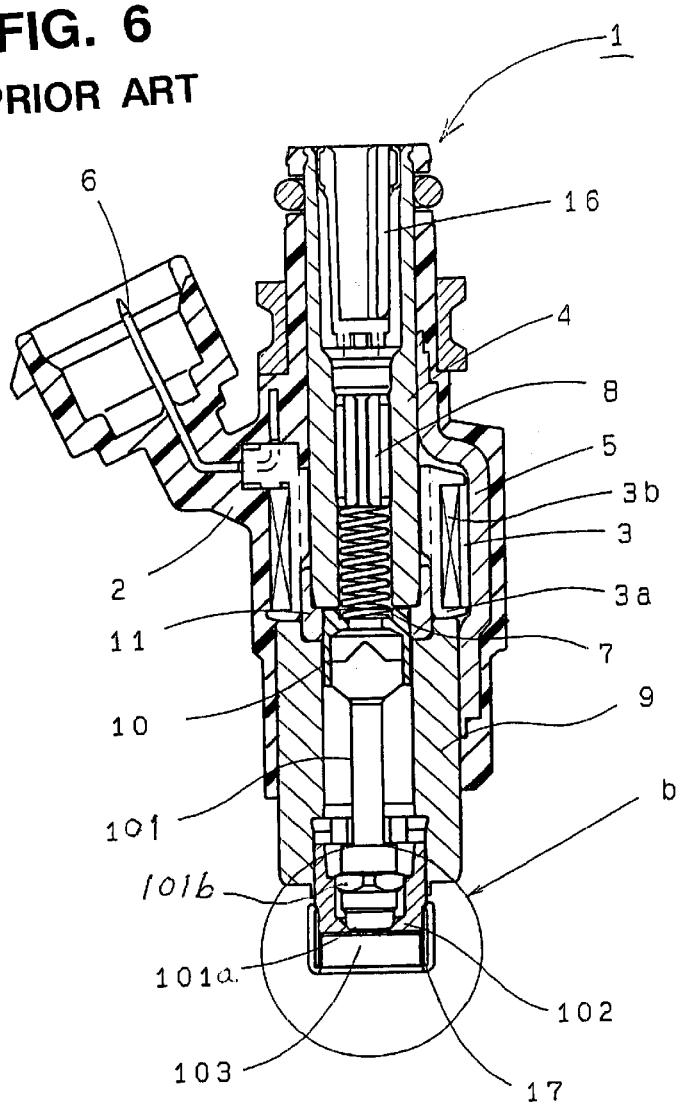
FIG. 6 PRIOR ART
FIG. 6 is a cross-sectional elevation of a known fuel injection valve.
Figure 7:
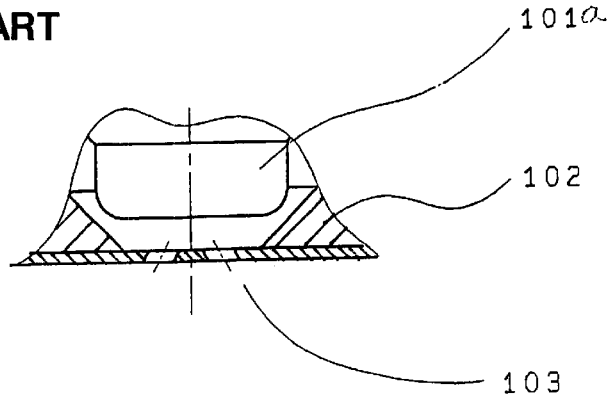
FIG. 7 PRIOR ART
FIG. 7 is an enlarged cross-sectional elevation showing the region containing the discharge orifices of the fuel injection valve of FIG. 6.

FIG. 5 shows the results of measurement of the relationship between S2/S1 and the SMD of fuel particles. As is clear from the graph, in the range in which S2/S1 is smaller than 1.0, the value of SMD is from approximately 100 to 120 micrometers. When S2/S1 approaches 1.0, SMD abruptly decreases, and it becomes approximately 90 micrometers at S2/S1=1.0. SMD further decreases when S2/S1 exceeds 1.0, and when S2/S1=1.5, SMD decreases to approximately 60 micrometers. As S2/S1 approaches 3.0, SMD again increases, and it becomes approximately 80 micrometers when S2/S1=3.0, and SMD further increases when S2/S1 exceeds 3.0. In this manner, SMD is within a satisfactorily small range when S2/S1 is larger than 1.0 and smaller than 3.0, and outside this range SMD becomes extremely large. Therefore, in order to make SMD small, it is important to satisfy the relationship $1<S2/S1<3$.

As described above, a fuel injection valve according to the present invention can provide advantages such as the following:

(1) By selecting the dimensions of the fuel injection valve to satisfy the inequalities $\phi D1+\phi d<\phi P$ and $t<\phi d$, atomization of fuel can be easily and effectively carried out, processing of the orifice plate is easy, and an inexpensive fuel injection valve can be obtained.

(2) By selecting the areas S1 and S2 in the fuel injection valve so as to satisfy the inequality $1<S2/S1<3$, the particle diameter of atomized fuel can be made even smaller.

(3) By forming the fuel cavity in the valve seat rather than in the orifice plate, it becomes unnecessary to perform an expensive metalworking process such as press forming on the orifice plate 17, so the orifice plate 17 can be a flat member which can be easily and inexpensively manufactured, thereby reducing the manufacturing costs of the fuel injection valve.

What is claimed is:

1. A fuel injection valve comprising:

an orifice plate having a plurality of discharge orifices formed therein;

a valve seat disposed upstream of the discharge orifices and having a cylindrical fuel passage formed therein;

a fuel cavity located between the cylindrical fuel passage and the orifice plate directly above the discharge orifices; and a valve member supported for reciprocating movement into and out of contact with the valve seat, wherein the fuel injection valve satisfies the inequalities $$\phi D1+\phi d<\phi P \text{ and } t<\phi d$$

wherein $\phi D1$ is the diameter of the cylindrical fuel passage, $\phi d$ is the diameter of each discharge orifice, $\phi P$ is the diameter of an imaginary circle passing through the center of each discharge orifice, and t is the depth in the axial direction of the fuel cavity.

2. A fuel injection valve as claimed in claim 1 wherein the fuel injection valve satisfies the inequality $$1<S2/S1<3$$

wherein S1 is the total cross-sectional area S1 of the discharge orifices, and S2 is the surface area of a cylindrical surface having a diameter equal to the diameter $\phi D1$ of the cylindrical fuel passage and a height equal to the axial depth t of the fuel cavity.

3. A fuel injection valve as claimed in claim 1 wherein the fuel cavity is formed in the valve seat.

* * * * *